US008755719B2

(12) United States Patent
Poterjoy et al.

(10) Patent No.: US 8,755,719 B2
(45) Date of Patent: Jun. 17, 2014

(54) TONER AGITATOR SYSTEM FOR A DEVELOPER UNIT FOR AN IMAGE FORMING DEVICE

(75) Inventors: Joshua Carl Poterjoy, Georgetown, KY (US); Jason Carl True, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 170 days.

(21) Appl. No.: 13/525,636

(22) Filed: Jun. 18, 2012

(65) Prior Publication Data

US 2013/0279941 A1 Oct. 24, 2013

Related U.S. Application Data

(60) Provisional application No. 61/635,579, filed on Apr. 19, 2012.

(51) Int. Cl.
*G03G 15/08* (2006.01)

(52) U.S. Cl.
USPC ..... 399/254

(58) Field of Classification Search
CPC ..... G03G 15/0822; G03G 15/0832; G03G 15/0889; G03G 15/0891
USPC ..... 399/254, 256, 262, 263
See application file for complete search history.

(56) References Cited

U.S. PATENT DOCUMENTS 5,239,346 A * 8/1993 Corbin et al. ..... 399/254
5,875,378 A 2/1999 Campbell et al.
2002/0028081 A1* 3/2002 Ito et al.

OTHER PUBLICATIONS

U.S. Appl. No. 13/340,789, filed Dec. 30, 2011 by Raymond Jay Barry et al.

* cited by examiner

*Primary Examiner* — Susan Lee
(74) *Attorney, Agent, or Firm* — Justin M Tromp

(57) ABSTRACT

A developer unit for use in an image forming device according to one example embodiment includes a housing having an inlet port for receiving toner, a sump for holding received toner and a developer roll rotatably mounted in the housing for transferring toner from the sump. A rotatable agitator is positioned in a lower portion of the sump and a pivotable agitator is positioned in an upper portion of the sump. A biasing member biases the pivotable agitator toward a stop in the pivot path of the pivotable agitator. The pivotable agitator includes an engagement feature positioned in the rotational path of the rotatable agitator when the pivotable agitator is in its home position. As the rotatable agitator rotates, the rotatable agitator engages and disengages the engagement feature causing the pivotable agitator to pivot away from and toward its home position.

21 Claims, 9 Drawing Sheets

TONER AGITATOR SYSTEM FOR A DEVELOPER UNIT FOR AN IMAGE FORMING DEVICE

CROSS REFERENCES TO RELATED APPLICATIONS

This application claims priority to U.S. Provisional Patent Application Ser. No. 61/635,579, filed Apr. 19, 2012, entitled "Toner Agitator System for a Replaceable Unit for an Image Forming Device," the content of which is hereby incorporated by reference in its entirety.

BACKGROUND

1. Field of the Disclosure

The present invention relates generally to electrophotographic image forming devices and more particularly to a toner agitator system for a developer unit for an image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll, a doctor blade and a photoconductive drum are positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit. In this configuration, the number of components housed in the toner cartridge is reduced in comparison with traditional toner cartridges.

Toner stored in a reservoir in the toner cartridge is delivered to a toner sump in the imaging unit where the toner is held until it is transferred to a print medium, such as paper, by various imaging components. One or more agitators may be employed in each of the reservoir and the toner sump to mix the stored toner and to break up packed toner. However, it may be difficult for the agitators to reach the entire volume of the toner reservoir and the toner sump to prevent toner from compacting in hard to reach areas. It is often desired that the agitators avoid contact with sensitive imaging components, such as a developer roll in the imaging unit, further limiting the ability to fully agitate the stored toner. Packed toner in the reservoir or toner sump may result in toner starvation where toner does not flow or only partially flows to the print medium even though a sufficient amount of toner remains in the reservoir and/or the toner sump. Accordingly, a toner agitator system that permits ample agitation of stored toner without contacting sensitive imaging components is desired.

SUMMARY

A developer unit for use in an image forming device according to a first example embodiment includes a housing having an inlet port for receiving toner, a sump for holding received toner and a developer roll rotatably mounted in the housing for transferring toner from the sump to a photoconductive drum when the developer unit is mated with a cleaner unit. A rotatable agitator is positioned in a lower portion of the sump. The rotatable agitator has a rotational path. A pivotable agitator is positioned in an upper portion of the sump above the rotatable agitator. The pivotable agitator has a pivot path.

A biasing member biases the pivotable agitator toward a stop in the pivot path of the pivotable agitator. The stop defines a home position of the pivotable agitator. The pivotable agitator includes an engagement feature positioned in the rotational path of the rotatable agitator when the pivotable agitator is in the home position. As the rotatable agitator rotates, the rotatable agitator engages the engagement feature causing the pivotable agitator to pivot away from the home position and as the rotatable agitator rotates further, the rotatable agitator disengages the engagement feature causing the pivotable agitator to return to the home position as a result of the bias applied to the pivotable agitator by the biasing member.

A developer unit for use in an image forming device according to a second example embodiment includes a housing having an inlet port for receiving toner, a sump for holding received toner, a developer roll rotatably mounted in the housing for transferring toner from the sump to a photoconductive drum when the developer unit is mated with a cleaner unit and a toner adder roll rotatably mounted in the housing for supplying toner from the sump to the developer roll. A rotatable agitator is positioned in the sump to present toner from the sump to the toner adder roll. The rotatable agitator has a rotational path. A pivotable agitator is positioned in the sump to move toner within the sump that is outside the reach of the rotatable agitator. The pivotable agitator has a pivot path. A biasing member biases the pivotable agitator toward a stop in the pivot path of the pivotable agitator. The stop defines a home position of the pivotable agitator. The pivotable agitator includes a tab positioned in the rotational path of the rotatable agitator when the pivotable agitator is in the home position. As the rotatable agitator rotates, the rotatable agitator engages the tab causing the pivotable agitator to pivot away from the home position and as the rotatable agitator rotates further, the rotatable agitator disengages the tab causing the pivotable agitator to return to the home position as a result of the bias applied to the pivotable agitator by the biasing member.

A developer unit for use in an image forming device according to a third example embodiment includes a housing having an inlet port for receiving toner, a sump for holding received toner, a developer roll rotatably mounted in the housing for transferring toner from the sump to a photoconductive drum when the developer unit is mated with a cleaner unit and a toner adder roll rotatably mounted in the housing for supplying toner from the sump to the developer roll. A rotatable agitator and a pivotable agitator are positioned in the sump. The rotatable agitator has a rotational path and the pivotable agitator has a pivot path. The rotatable agitator is positioned closer to the toner adder roll than the pivotable agitator. A biasing member biases the pivotable agitator toward a stop in the pivot path of the pivotable agitator. The stop defines a home position of the pivotable agitator. The pivotable agitator includes an engagement feature positioned in the rotational path of the rotatable agitator when the pivotable agitator is in the home position. As the rotatable agitator rotates, the rotatable agitator engages the engagement feature causing the pivotable agitator to pivot away from the home position and as the rotatable agitator rotates further, the rotatable agitator disengages the engagement feature causing the pivotable agitator to return to the home position as a result of the bias applied to the pivotable agitator by the biasing member.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
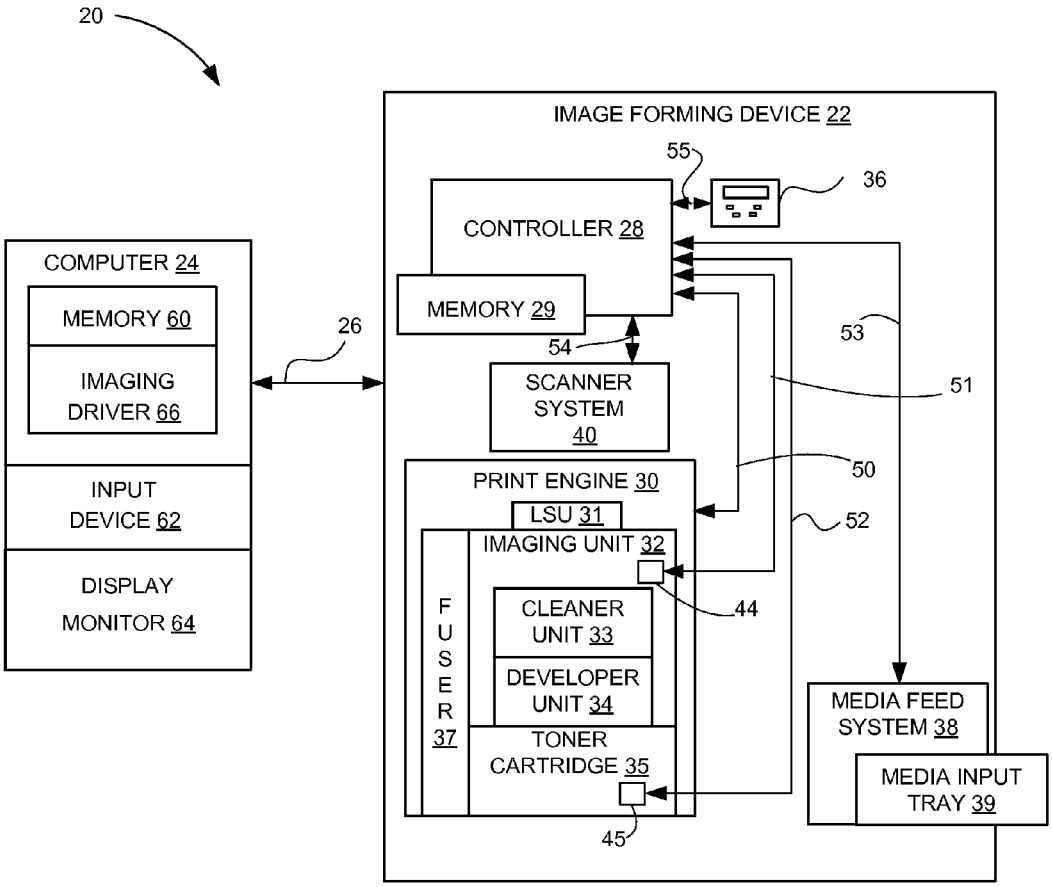
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory of combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and fuser 37, all mounted within image forming device 22. Imaging unit 32 is removably mounted in image forming device 22 and includes a developer unit 34 that houses a toner reservoir (or toner sump) and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in imaging unit 32 in a mating relationship with developer unit 34 of imaging unit 32. An exit port on toner cartridge 35 communicates with an entrance port on developer unit 34 allowing toner to be periodically transferred from a reservoir in toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
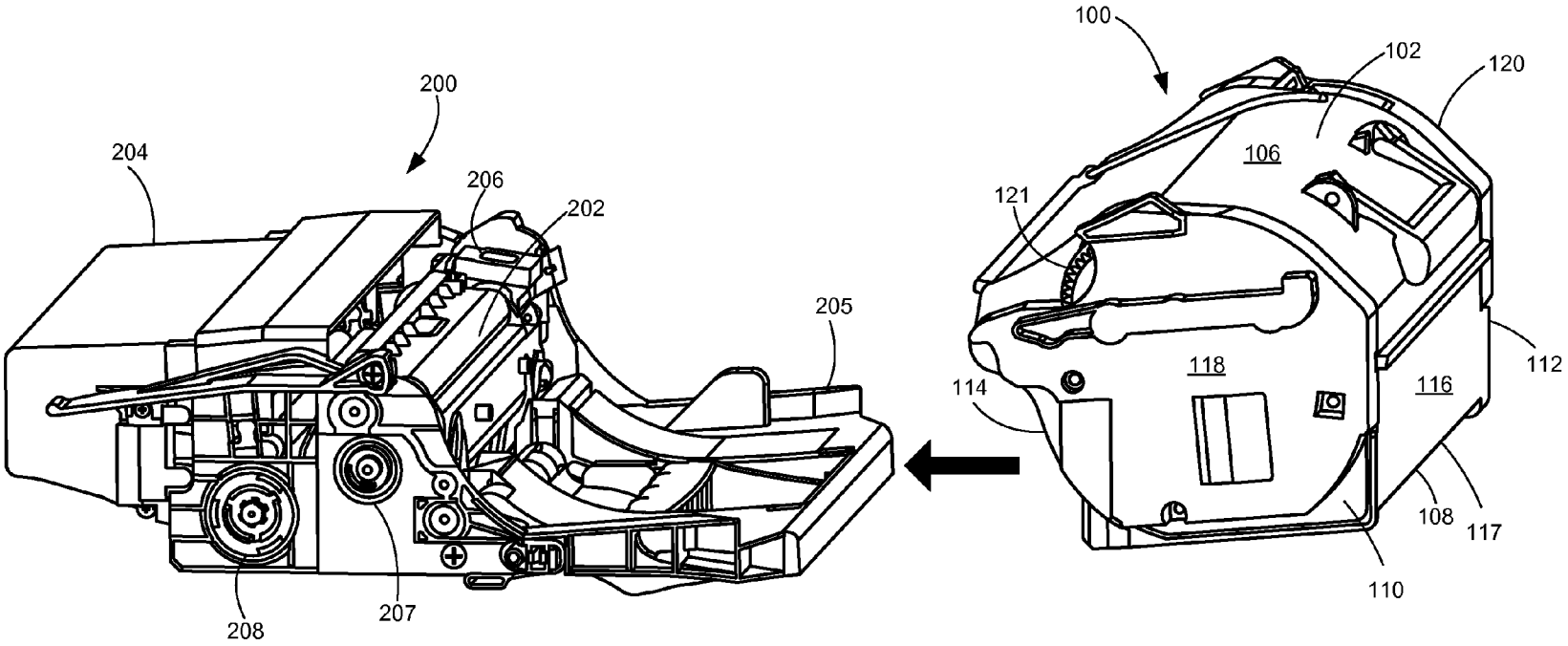
FIG. 2 is a perspective view of a toner cartridge and an imaging unit according to one example embodiment.

Referring now to FIG. 2, a toner cartridge 100 and an imaging unit 200 are shown according to one example embodiment. Imaging unit 200 includes a developer unit 202 and a cleaner unit 204 mounted on a common frame 205. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 205 in a mating relationship with developer unit 202 of imaging unit 200 as indicated by the arrow shown in FIG. 2. This arrangement allows toner cartridge 100 to be removed and reinserted easily when replacing an empty toner cartridge without having to remove imaging unit 200. Imaging unit 200 may also be readily removed as desired in order to maintain, repair or replace the components associated with developer unit 202, cleaner unit 204 or frame 205 or to clear a media jam.

Toner cartridge 100 includes a housing 102 having an enclosed reservoir for holding a quantity of toner therein. Housing 102 may be viewed as having a top or lid 106 mounted on a base 108. Base 108 is formed by first and second side walls 110, 112 connected to adjoining front and rear walls 114, 116 and bottom 117. In one embodiment, top 106 is ultrasonically welded to base 108 thereby forming the enclosed toner reservoir. Housing 102 also includes first and second end caps 118, 120 that are mounted to side walls 110, 112, respectively. First and second end caps 118, 120 may be snap fitted into place or attached by screws or other fasteners onto base 108. Various gears and/or linkages are housed within the space between end cap 118 and side wall 110 and between end cap 120 and side wall 112. These gears and linkages are used for operation of interlocks that engage with imaging unit 200 and for operation of a toner delivery system within toner cartridge 100 that includes a toner paddle assembly, a feed auger, a gear train, and an exit port shutter for toner cartridge 100. As mentioned above, toner cartridge 100 removably mates with developer unit 202 of imaging unit 200. An exit port (not shown) on the front 114 of toner cartridge 100 communicates with an inlet port 206 on developer unit 202 allowing toner to be periodically transferred from toner cartridge 100 to resupply the toner sump in developer unit 202.

A main interface gear 121 for toner cartridge 100 is mounted in end cap 118. Main interface gear 121 receives torque from a first drive system housed within image forming device 22 and, in turn, drives the feed auger and the toner paddle assembly through one or more intermediate gears for the delivery of toner from toner cartridge 100 to developer unit 202. Similarly, imaging unit 200 includes a pair of input couplers 207, 208 exposed through a side portion of frame 205 that receive torque at their axial ends from a second and a third drive system, respectively, in image forming device 22. Input coupler 207 drives various rotatable components in developer unit 202 as discussed below. Input coupler 208 drives the photoconductive drum in cleaner unit 204.

Figure 3:
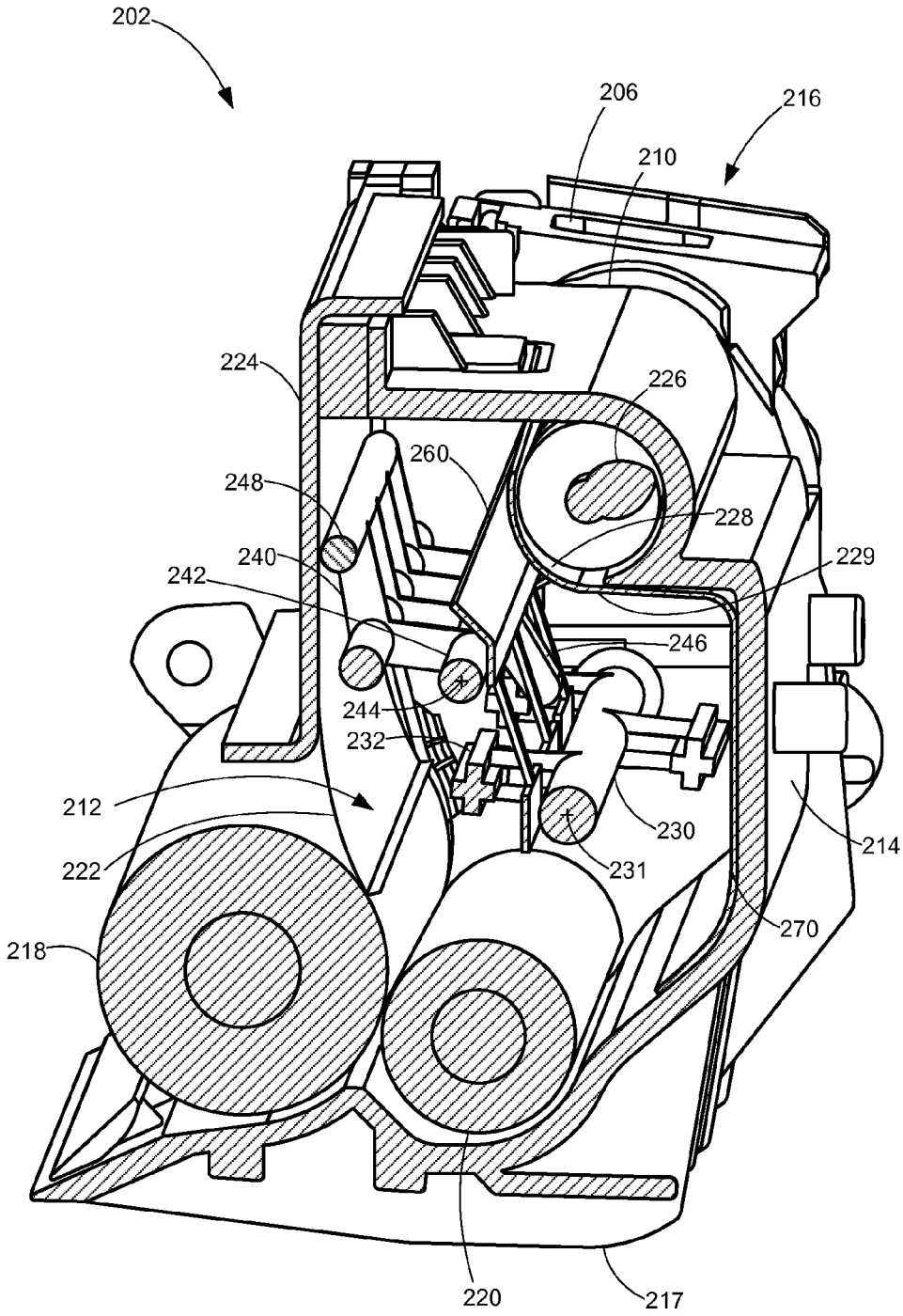
FIG. 3 is a cutaway view of a developer unit having a rotatable toner agitator and a pivotable toner agitator according to one example embodiment.

With reference to FIG. 3, developer unit 202 includes a housing 210 enclosing a toner sump 212 sized to hold a quantity of toner. Toner sump 212 is formed by a rear wall 214, first and second side walls 215, 216 (FIGS. 8A and 8B) and a bottom 217. FIG. 3 shows a cutaway view of developer unit 202 through a side portion of housing 210 to more clearly illustrate the internal components of developer unit 202. Cleaner unit 204, which would be positioned in front of developer unit 202 (i.e., to the left in FIG. 3), and frame 205 are not shown. A developer roll 218 and a toner adder roll 220 are mounted within toner sump 212. Toner adder roll 220 moves toner supplied to toner sump 212 by toner cartridge 100 to developer roll 218. A doctor blade 222 is disposed along and engages with developer roll 218 to provide a substantially uniform layer of toner on developer roll 218 for subsequent transfer to a latent image on the photoconductive drum in cleaner housing 204. In the example embodiment illustrated, doctor blade 222 is mounted on a bracket 224, e.g., by spot welds. Bracket 224 is attached to housing 210, e.g., by suitable fasteners. Inlet port 206 aligns with the exit port of toner cartridge 100 when toner cartridge 100 is installed along frame 205 and mated with developer unit 202. In one example form, inlet port 206 may be larger in area than the exit port of toner cartridge 100. A rotating auger 226 and gutter 228 are positioned laterally along an upper portion of toner sump 212 near inlet port 206. Gutter 228 includes a plurality of openings (not shown) spaced along its length. The openings extend through a bottom surface 229 of gutter 228. Toner entering inlet port 206 from toner cartridge 100 is distributed along the length of gutter 228 by the rotation of auger 226. The openings in gutter 228 allow the incoming toner to be distributed substantially evenly into toner sump 212.

Figure 4A:
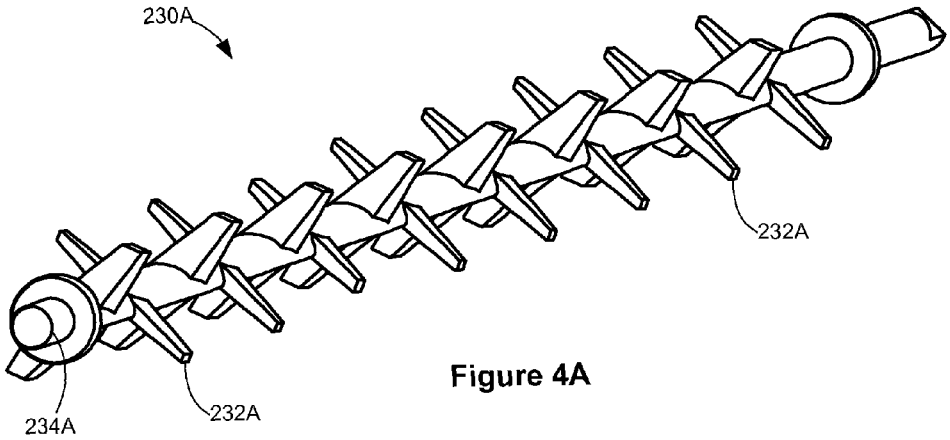
FIG. 4A is a perspective view of a rotatable toner agitator according to a first example embodiment.
Figure 4B:
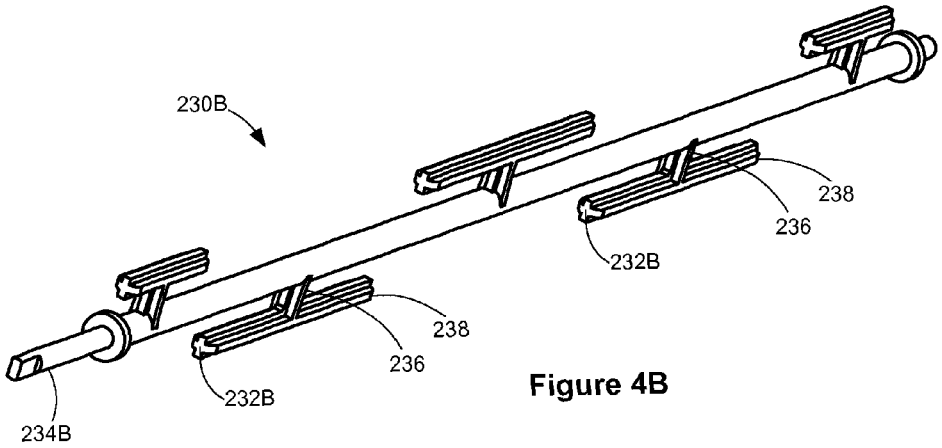
FIG. 4B is a perspective view of a rotatable toner agitator according to a second example embodiment.
Figure 4C:
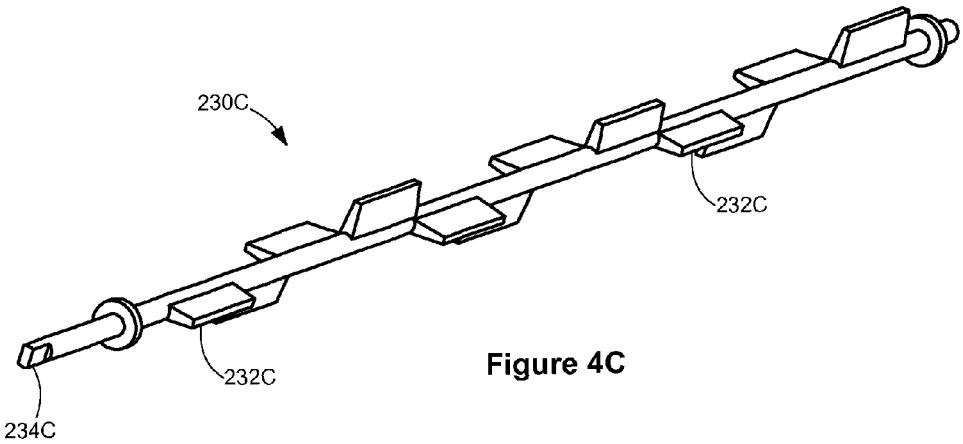
FIG. 4C is a perspective view of a rotatable toner agitator according to a third example embodiment.

A rotatable toner agitator 230 spans laterally across a lower portion of toner sump 212 near toner adder roll 220 between side wall 215 and side wall 216. Input coupler 207 (shown in FIG. 2), through one or more intermediate gears positioned on the outside of side wall 215 and/or side wall 216, drives rotatable agitator 230 as well as developer roll 218, toner adder roll 220 and auger 226. Rotatable agitator 230 includes one or more blades or paddles 232 and is rotatable about an axis of rotation 231. Rotatable agitator 230 is positioned to stir and move toner within toner sump 212 to present to toner adder roll 220 and developer roll 218. In stirring and moving toner, rotatable agitator 230 prevents toner particles from forming larger clumps within toner sump 212. Rotatable agitator 230 may take many shapes and forms. FIGS. 4A-4C show example embodiments of suitable rotatable agitator structures. FIG. 4A shows agitator 230A having a drive shaft 234A and a plurality of axially spaced blades 232A extending radially outward from drive shaft 234A. In FIG. 4B, each blade 232B of a rotatable agitator 230B is shaped to form a substantially T-shaped structure. Each blade 232B includes a connecting bar 236 extending radially outward from drive shaft 234B and a breaker bar 238 extending from connecting bar 236 in substantially parallel orientation with drive shaft 234B. Connecting bars 236 and breaker bars 238 may have T-shaped or cross-shaped cross sections and a number of edges which may aid in chipping apart and driving through settled and/or compacted toner within toner sump 212. FIG. 4C shows a rotatable agitator 230C that includes a plurality of paddles or blades 232C radially extending from a drive shaft 234C and arranged in a substantially helical relationship along drive shaft 234C with substantially no axial distance between adjacent blades 232C. It will be recognized that blades 232 may be of other various geometrical shapes such as, for example, substantially cylindrical, rectangular, triangular, conical, etc., and may be of different lengths and/or dimensions, or angular orientations with respect to each other or relative to drive shaft 234.

With reference back to FIG. 3, a pivotable toner agitator 240 spans laterally across an upper portion of toner sump 212. Pivotable agitator 240 includes a shaft 242 that is rotatable about a pivot point 244. One or more tabs 246 extend from shaft 242 into the path of rotatable agitator 230. Pivotable agitator 240 includes one or more blades, paddles or other agitating members 248 extending from shaft 242. Pivotable agitator 240 is positioned to move toner within toner sump 212 that is outside the reach of rotatable agitator 230 in order to further prevent toner particles from forming larger clumps within toner sump 212.

Figure 5A:
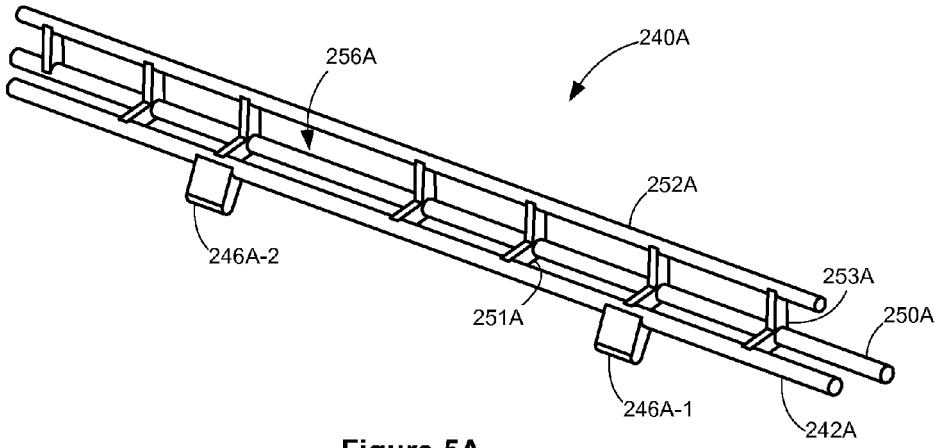
FIG. 5A is a perspective view of a pivotable toner agitator according to a first example embodiment.

Like rotatable agitator 230, pivotable agitator 240 may take many shapes and forms. For example, FIG. 5A shows a pivotable agitator 240A having a shaft 242A and a pair of tabs 246A-1, 246A-2 extending radially outward from shaft 242A into the path of rotatable agitator 230. A first (or middle) rod 250A is connected to shaft 242A by one or more cross braces 251A. Similarly, a second (or outer) rod 252A is connected to middle rod 250A by one or more cross braces 253A. In one embodiment, shaft 242A, middle rod 250A and outer rod 252A are substantially parallel to each other. Cross braces 251A, 253A provide strength and structural support for rods 250A, 252A. In the example embodiment illustrated, cross braces 251A and 253A are axially aligned with each other. Alternatively, cross braces 251A and 253A may be axially offset from each other as desired. Gaps or windows 256A are formed between cross braces 251A, 253A and rods 250A, 252A. Windows 256A allow pivotable agitator 240A to easily sweep through toner in toner sump 212 creating a mixing effect and preventing toner packing. Rods 250A, 252A and cross braces 251A, 253A are positioned to prevent pivotable agitator 240 from catching on any of the other components housed within toner sump 212, which could lead to toner starvation of developer roll 218 potentially causing print defects.

Figure 5B:
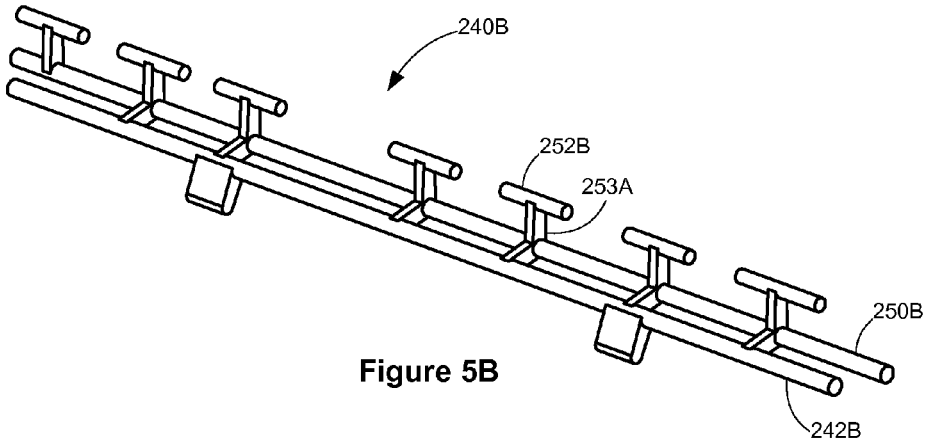
FIG. 5B is a perspective view of a pivotable toner agitator according to a second example embodiment.
Figure 5C:
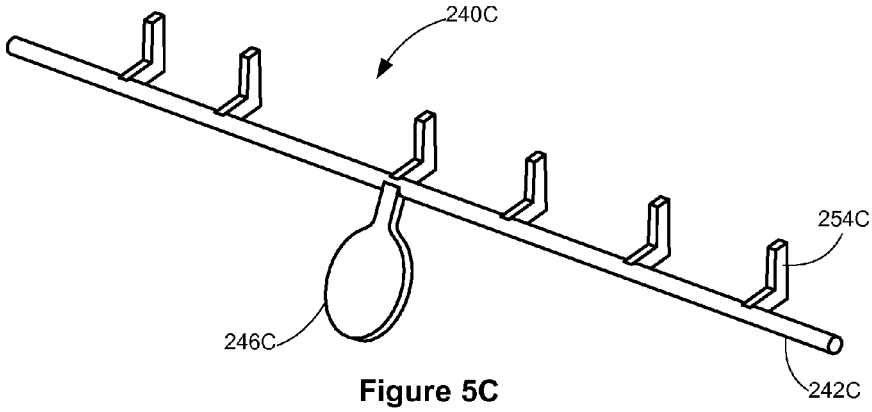
FIG. 5C is a perspective view of a pivotable toner agitator according to a third example embodiment.

FIG. 5B shows a pivotable agitator 240B similar to pivotable agitator 240A except that outer rod 252A is formed in segments such that agitator 240B includes a series of T-shaped structures extending from middle rod 250B. Each T-shaped structure includes a cross brace 253B that extends radially outward from middle rod 250B and a rod segment 252B that extends from cross brace 253B in substantially parallel orientation with shaft 242B and middle rod 250B. In FIG. 5C, a pivotable agitator 240C includes a series of axially spaced blades 254C extending radially outward from shaft 242C. A tab 246C extends radially from shaft 242C into the path of rotatable agitator 230. It will be appreciated that tabs 246 and agitating members 248 of pivotable agitator 240 may be of other various geometrical shapes such as, for example, substantially cylindrical, rectangular, triangular, conical, etc., and may be of different lengths and/or dimensions, or angular orientations with respect to each other or relative to shaft 242.

Figure 6A:
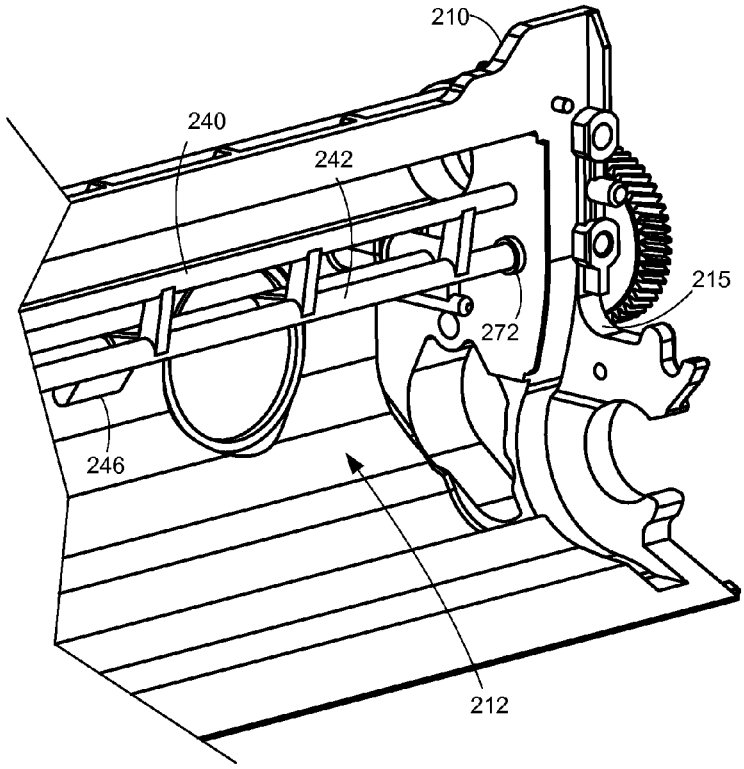
FIG. 6A is a perspective view showing the pivotable toner agitator mounted to a housing of the developer unit according to one example embodiment.
Figure 6B:
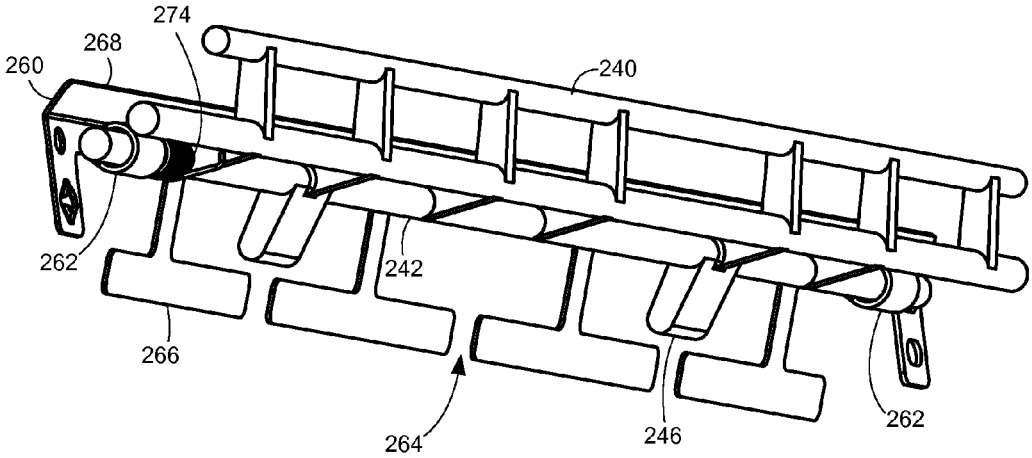
FIG. 6B is a perspective view showing the pivotable toner agitator mounted to an electrically conductive plate according to one example embodiment.

Pivotable agitator 240 may be mounted in toner sump 212 by any suitable means, such as by being mounted to housing 210. For example, as shown in FIG. 6A, each end of shaft 242 may be rotatably positioned in a bearing 272 on the inner surface of a respective side wall 215, 216 of housing 210. Alternatively, pivotable agitator 240 may be mounted to another component positioned within toner sump 212. For example, as shown in FIGS. 3 and 6B, in one embodiment, pivotable agitator 240 is rotatably mounted on an electrically conductive plate 260 that spans laterally across a central region of toner sump 212. In the example embodiment illustrated, shaft 242 is pivotably positioned in bearings 262 formed in conductive plate 260. Two bearings 262 are illustrated, although more bearings 262 may be used as desired. Bearings 262 and conductive plate 260 may be formed from a single sheet of metal.

Conductive plate 260 forms a first electrode of a capacitive toner level sensor that uses multiple plates to measure the relative toner levels contained in toner sump 212. In the example embodiment illustrated in FIG. 3, a second electrode is formed by gutter 228 and an electrically conductive plate 270 disposed along rear wall 214 of toner sump 212. Conductive plate 270 and gutter 228 may be formed from a single sheet of metal. A third electrode is formed by an electrically conductive doctor blade 222 which is disposed on the opposite side of toner sump 212 from conductive plate 270 and gutter 228 such that conductive plate 260 is positioned between doctor blade 222 and the combination of gutter 228 and conductive plate 270. The three electrodes form three plates of the capacitive sensor. The three plates form two parallel connected capacitors whose capacitance varies in response to the amount of toner existing between corresponding electrodes of the two capacitors. Conductive plate 260 serves as a sense plate for sensing a capacitance value, indicating the toner level within toner sump 212. In one embodiment, doctor blade 222 and the combination of gutter 228 and conductive plate 270 are electrically coupled together and driven by a common signal source, such as an AC voltage signal source. Alternatively, gutter 228 and conductive plate 270 may be electrically insulated from doctor blade 222 and driven by separate voltage signal sources. As shown in FIG. 3, conductive sense plate 260 may be positioned adjacent rotatable agitator 230 and may have one or more slots 264 (FIG. 6B) formed through a body thereof to allow blades 232 of rotatable agitator 230 to pass through as it rotates. Conductive sense plate 260 may have different shapes as desired. In the example embodiment shown in FIG. 6B, conductive sense plate 260 includes inverted T-shaped fingers 266 extending from an elongated plate portion 268 with adjacent fingers 266 being separated from each other forming slots 264 that allow blades 232 to pass. Fingers 266 increase the surface area of conductive plate 260.

With reference back to FIG. 3, pivotable agitator 240 is biased by a biasing member 274 (FIG. 6B), such as a torsion spring, toward a home position. FIG. 3 shows pivotable agitator 240 in its home position with tab(s) 246 in the rotational path of blades 232 of rotatable agitator 230 and agitating member(s) 248 biased against doctor blade bracket 224. In this configuration, doctor blade bracket 224 serves as a stop to limit the rotation of pivotable agitator 240. Tab(s) 246 serve as an engagement feature and provide a contact point for rotatable agitator 230 to displace pivotable agitator 240. Where pivotable agitator 240 includes multiple tabs 246, tabs 246 may be positioned to contact blades 232 that are radially offset from each other so that pivotable agitator 240 is actuated multiple times during each revolution of rotatable agitator 230. Alternatively, pivotable agitator 240 may be actuated multiple times during each revolution of rotatable agitator 230 by positioning a single tab 246 in the path of multiple axially aligned and radially offset blades 232. It will be appreciated that various frequencies of actuation of pivotable agitator 240 may be achieved by altering the configuration of tab(s) 246 and blades 232.

Figure 7C:
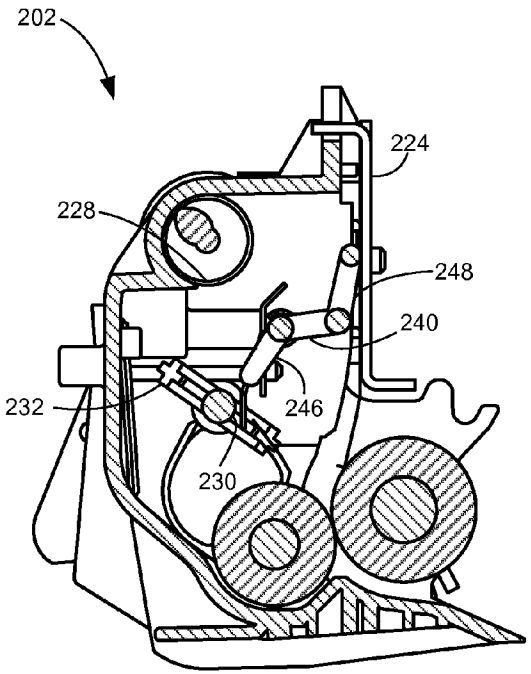
FIGS. 7A-7C are sequential side cutaway views showing the actuation of the pivotable toner agitator by the rotatable toner agitator according to one example embodiment.
Figure 7B:
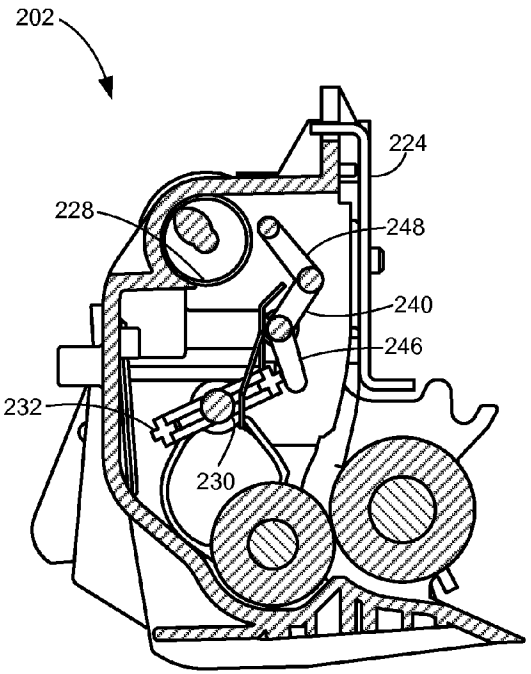
Figure 7A:
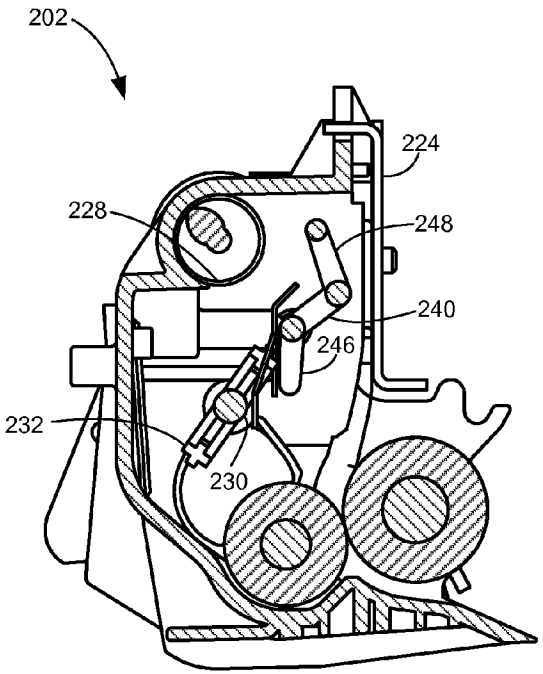

FIG. 7A-C show sequential views illustrating the actuation and movement of pivotable agitator 240 according to one example. As rotatable agitator 230 rotates (in a clockwise direction as viewed in FIGS. 7A-C), one or more blades 232 contact tab(s) 246 overcoming the bias applied by biasing member 274 and causing pivotable agitator 240 to rotate about its pivot point 244 (in a counterclockwise direction as viewed in FIGS. 7A-C). This causes agitating member(s) 248 to move away from doctor blade bracket 224 and toward gutter 228 until pivotable agitator 240 reaches the end of its travel with agitating member(s) 248 against or near gutter 228 as shown in FIG. 7B. As rotatable agitator 230 rotates further, blade(s) 232 disengage from tab(s) 246 causing pivotable agitator 240 to pivot (in a clockwise direction as viewed in FIGS. 7A-C) back to its home position as a result of the bias applied by biasing member 274 as shown in FIG. 7C. Pivotable agitator 240 continues to pivot back and forth as rotatable agitator 230 rotates and blade(s) 232 engage and disengage from tab(s) 246. In the example embodiment illustrated, when pivotable agitator 240 returns to its home position, it impacts doctor blade bracket 224 causing vibration through pivotable agitator 240 and conductive plate 260. This vibration helps remove any built up toner from pivotable agitator 240 and conductive plate 260. However, the impact is not severe enough to cause a print defect and is substantially inaudible over the operation of image forming device 22.

In another embodiment, the configuration of pivotable agitator 240 is reversed such that in its home position, agitating member(s) 248 are biased against gutter 228. In this embodiment, the rotation of rotatable agitator 230 actuates tab(s) 246 and causes agitating member(s) 248 to pivot away from gutter 228 and toward doctor blade bracket 224. This may be accomplished, for example, by reversing the rotation of rotatable agitator 230. When blades 232 disengage from tab(s) 246, agitating member(s) 248 pivot back toward gutter 228, which may serve as a stop to limit the rotation of pivotable agitator 240 in this embodiment.

The back and forth pivoting motion of pivotable agitator 240 mixes and breaks up residual toner in toner sump 212 not agitated by rotatable agitator 230. Where developer unit 202 includes a capacitive toner level sensor, it has been observed that the motion of pivotable agitator 240 also forces toner into the areas between the capacitive plates which improves the measurement accuracy of the toner level sensor.

Figure 8A:
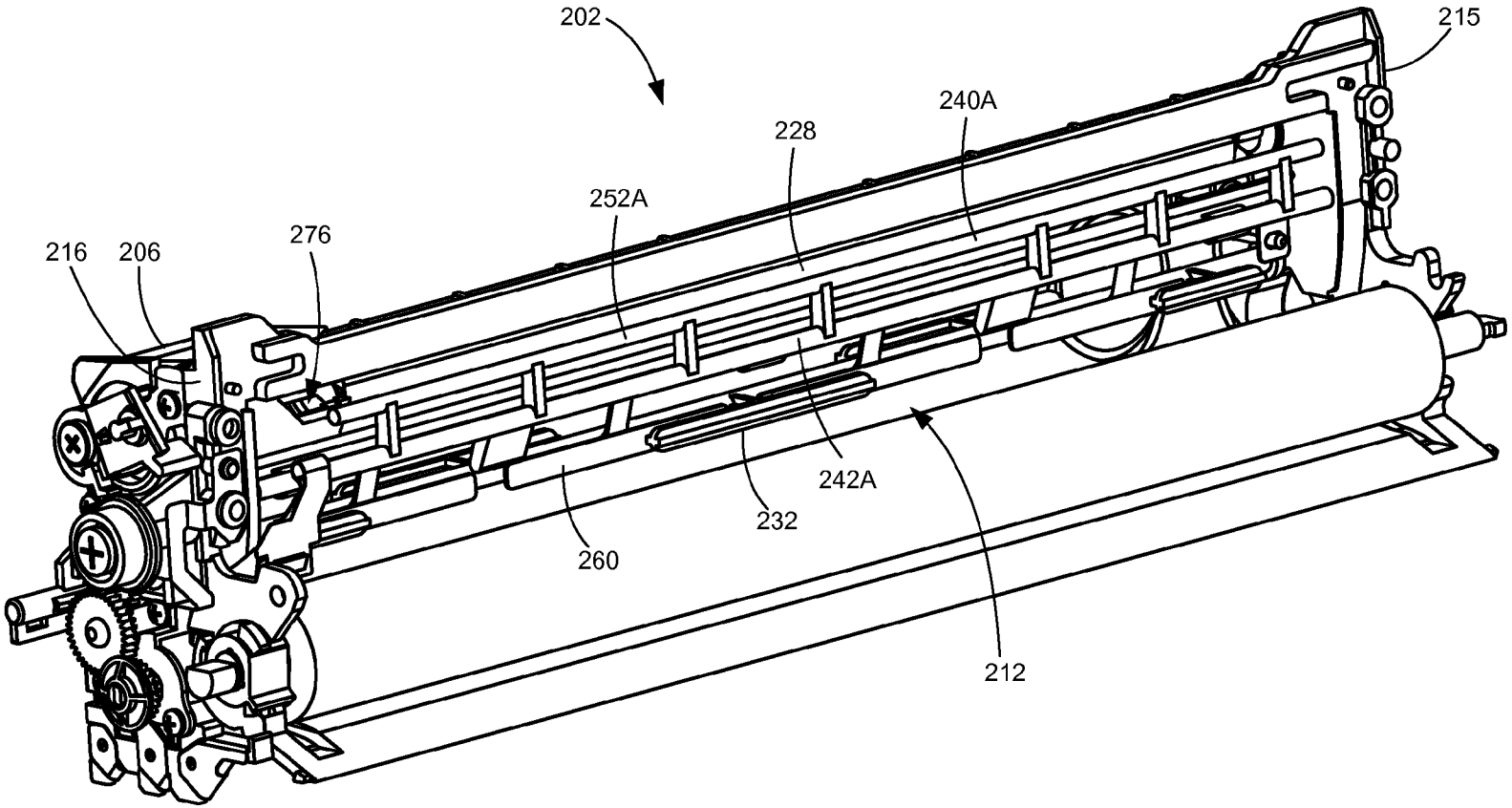
FIGS. 8A and 8B are front perspective views of the developer unit with a doctor blade assembly removed showing the pivotable agitator in a home position and a rotated position, respectively, according to one example embodiment.
Figure 8B:
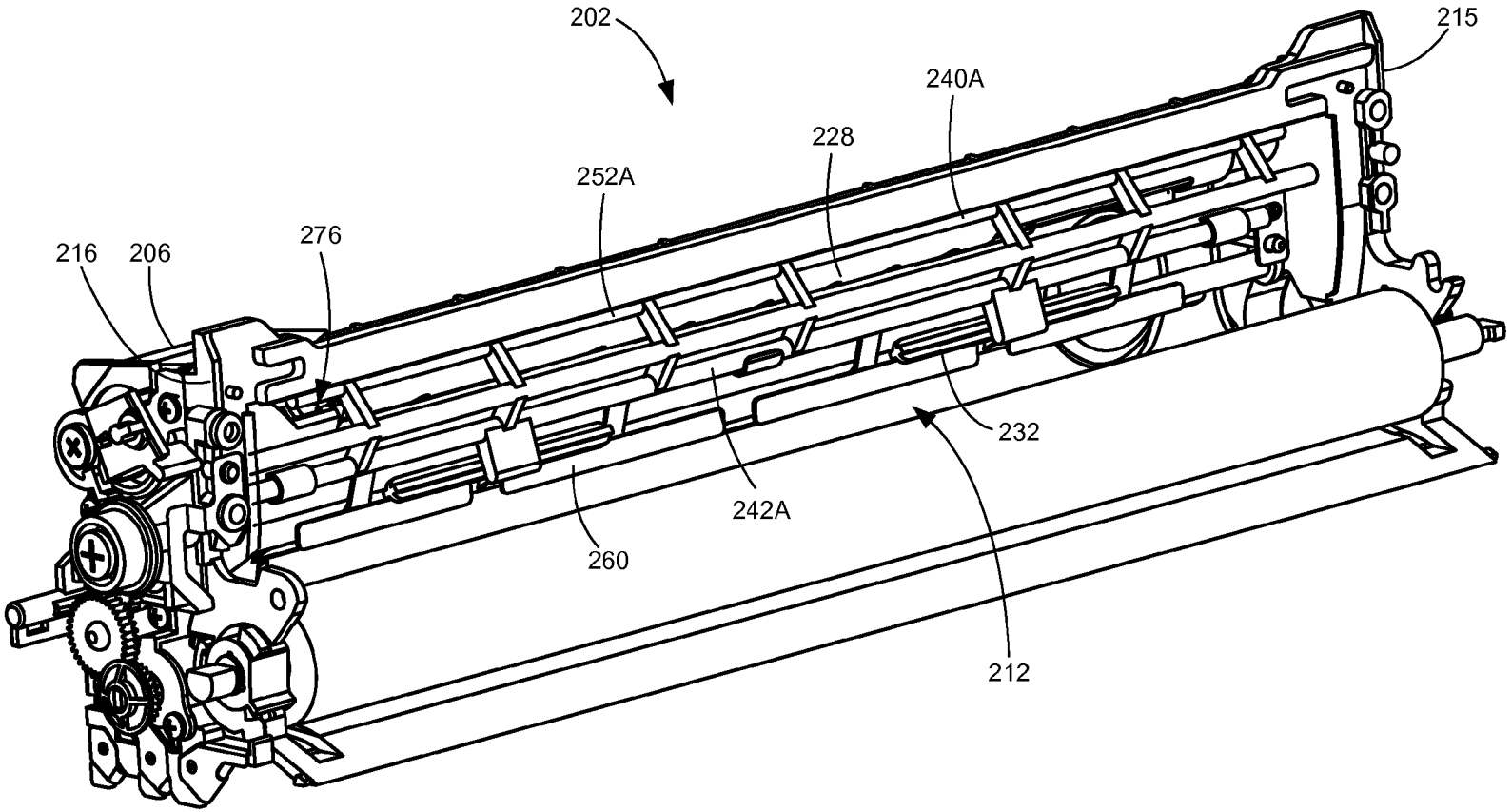

FIGS. 8A and 8B show developer unit 202 from the front with doctor blade 222 and bracket 224 removed to illustrate toner sump 212. FIG. 8A shows pivotable agitator 240 in its home position and FIG. 8B shows pivotable agitator 240 rotated to the end of its travel by rotatable agitator 230 with outer rod 252A near gutter 228. In the example embodiment shown in FIGS. 8A and 8B, gutter 228 includes an opening 276 in a front portion thereof where toner is received through inlet port 206. Opening 276 permits toner to enter toner sump 212. Opening 276 also permits air to escape toner sump 212 through inlet port 206 and enter the exit port on toner cartridge 100. In one embodiment, toner cartridge 100 includes a passageway in fluid communication with its exit port that allows air to vent to the exterior of toner cartridge 100. This permits pressure equalization between developer unit 202 and toner cartridge 100 eliminating a potential vacuum or low pressure region that may accumulate in the toner reservoir of toner cartridge 100. In the example embodiment shown, pivotable agitator 240 aids in clearing any toner blocking opening 276. As shown in FIG. 8B, when pivotable agitator 240 is fully actuated by rotatable agitator 230, outer rod 252A extends into opening 276 breaking up any toner accumulating in opening 276 to keep opening 276 clear.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for use in an image forming device, comprising:

a housing having reservoir for storing toner;

a rotatable agitator positioned in the reservoir, the rotatable agitator having a rotational path;

a pivotable agitator positioned in an upper portion of the reservoir above the rotatable agitator, the pivotable agitator having a pivot path; and a biasing member biasing the pivotable agitator toward a stop in the pivot path of the pivotable agitator, the stop defining a home position of the pivotable agitator;

wherein the pivotable agitator includes an engagement feature positioned in the rotational path of the rotatable agitator when the pivotable agitator is in the home position, wherein as the rotatable agitator rotates, the rotatable agitator engages the engagement feature causing the pivotable agitator to pivot away from the home position and as the rotatable agitator rotates further, the rotatable agitator disengages the engagement feature causing the pivotable agitator to return to the home position as a result of the bias applied to the pivotable agitator by the biasing member.

2. A developer unit for use in an image forming device, comprising:

a housing having an inlet port for receiving toner, a sump for holding received toner and a developer roll rotatably mounted in the housing for transferring toner from the sump to a photoconductive drum when the developer unit is mated with a cleaner unit;

a rotatable agitator positioned in a lower portion of the sump, the rotatable agitator having a rotational path;

a pivotable agitator positioned in an upper portion of the sump above the rotatable agitator, the pivotable agitator having a pivot path; and a biasing member biasing the pivotable agitator toward a stop in the pivot path of the pivotable agitator, the stop defining a home position of the pivotable agitator;

wherein the pivotable agitator includes an engagement feature positioned in the rotational path of the rotatable agitator when the pivotable agitator is in the home position, wherein as the rotatable agitator rotates, the rotatable agitator engages the engagement feature causing the pivotable agitator to pivot away from the home position and as the rotatable agitator rotates further, the rotatable agitator disengages the engagement feature causing the pivotable agitator to return to the home position as a result of the bias applied to the pivotable agitator by the biasing member.

3. The developer unit of claim 2, further comprising a doctor blade disposed along the developer roll and mounted to the housing by a bracket, wherein the bracket forms the stop in the pivot path of the pivotable agitator.

4. The developer unit of claim 2, wherein the pivotable agitator includes a rotatable shaft and at least one agitating member extending outward from the shaft and above the shaft, the engagement feature extending outward from the shaft into the rotational path of the rotatable agitator when the pivotable agitator is in the home position.

5. The developer unit of claim 4, wherein the at least one agitating member includes a first rod connected to the shaft by a first set of one or more cross braces.

6. The developer unit of claim 5, wherein the at least one agitating member further includes a second rod connected to the first rod by a second set of one or more cross braces.

7. The developer unit of claim 6, wherein the shaft, the first rod and the second rod extend laterally across the toner sump and are substantially parallel to each other.

8. The developer unit of claim 6, wherein a first plurality of windows are formed between the second rod, the first rod and the second set of one or more cross braces.

9. The developer unit of claim 8, wherein a second plurality of windows are formed between the first rod, the shaft and the first set of one or more cross braces.

10. The developer unit of claim 2, wherein the pivotable agitator is mounted to a component positioned within the sump.

11. The developer unit of claim 10, wherein the pivotable agitator is mounted to an electrically conductive plate that spans laterally across the sump and forms an electrode of a capacitive toner level sensor.

12. The developer unit of claim 2, further comprising a gutter that spans laterally across the upper portion of the sump for distributing toner received by the inlet port to the sump, the gutter having an opening in a front portion thereof adjacent the inlet port for permitting air to escape the sump through the inlet port, wherein at the end of the travel of the pivotable agitator away from the home position, a portion of the pivotable agitator extends into the opening.

13. A developer unit for use in an image forming device, comprising:

a housing having an inlet port for receiving toner, a sump for holding received toner, a developer roll rotatably mounted in the housing for transferring toner from the sump to a photoconductive drum when the developer unit is mated with a cleaner unit and a toner adder roll rotatably mounted in the housing for supplying toner from the sump to the developer roll;

a rotatable agitator positioned in the sump to present toner from the sump to the toner adder roll, the rotatable agitator having a rotational path;

a pivotable agitator positioned in the sump to move toner within the sump that is outside the reach of the rotatable agitator, the pivotable agitator having a pivot path; and a biasing member biasing the pivotable agitator toward a stop in the pivot path of the pivotable agitator, the stop defining a home position of the pivotable agitator;

wherein the pivotable agitator includes a tab positioned in the rotational path of the rotatable agitator when the pivotable agitator is in the home position, wherein as the rotatable agitator rotates, the rotatable agitator engages the tab causing the pivotable agitator to pivot away from the home position and as the rotatable agitator rotates further, the rotatable agitator disengages the tab causing the pivotable agitator to return to the home position as a result of the bias applied to the pivotable agitator by the biasing member.

14. The developer unit of claim 13, further comprising a doctor blade disposed along the developer roll and mounted to the housing by a bracket, wherein the bracket forms the stop in the pivot path of the pivotable agitator.

15. The developer unit of claim 13, wherein the pivotable agitator includes a rotatable shaft and at least one agitating member extending outward from the shaft, the tab extending outward from the shaft into the rotational path of the rotatable agitator when the pivotable agitator is in the home position.

16. The developer unit of claim 15, wherein the at least one agitating member includes a first rod connected to the shaft by a first set of one or more cross braces and a second rod connected to the first rod by a second set of one or more cross braces.

17. The developer unit of claim 16, wherein a first plurality of windows are formed between the second rod, the first rod and the second set of one or more cross braces and a second plurality of windows are formed between the first rod, the shaft and the first set of one or more cross braces.

18. The developer unit of claim 13, wherein the pivotable agitator is mounted to a component positioned within the sump.

19. The developer unit of claim 18, wherein the pivotable agitator is mounted to an electrically conductive plate that spans laterally across the sump and forms an electrode of a capacitive toner level sensor.

20. The developer unit of claim 13, further comprising a gutter that spans laterally across an upper portion of the sump for distributing toner received by the inlet port to the sump, the gutter having an opening in a front portion thereof adjacent the inlet port for permitting air to escape the sump through the inlet port, wherein at the end of the travel of the pivotable agitator away from the home position, a portion of the pivotable agitator extends into the opening.

21. A developer unit for use in an image forming device, comprising:

a housing having an inlet port for receiving toner, a sump for holding received toner, a developer roll rotatably mounted in the housing for transferring toner from the sump to a photoconductive drum when the developer unit is mated with a cleaner unit and a toner adder roll rotatably mounted in the housing for supplying toner from the sump to the developer roll;

a rotatable agitator and a pivotable agitator positioned in the sump, the rotatable agitator having a rotational path and the pivotable agitator having a pivot path, the rotatable agitator being positioned closer to the toner adder roll than the pivotable agitator;

a biasing member biasing the pivotable agitator toward a stop in the pivot path of the pivotable agitator, the stop defining a home position of the pivotable agitator;

wherein the pivotable agitator includes an engagement feature positioned in the rotational path of the rotatable agitator when the pivotable agitator is in the home position, wherein as the rotatable agitator rotates, the rotatable agitator engages the engagement feature causing the pivotable agitator to pivot away from the home position and as the rotatable agitator rotates further, the rotatable agitator disengages the engagement feature causing the pivotable agitator to return to the home position as a result of the bias applied to the pivotable agitator by the biasing member.

* * * * *